United States Patent [19]

Stout

[11] 3,967,487

[45] July 6, 1976

[54] AUTOMATIC APPARATUS AND METHOD FOR SIMULTANEOUSLY FORMING EYES ON EACH END OF A LEAF SPRING BLANK

[75] Inventor: Dean Stout, Winamac, Ind.

[73] Assignee: Winamac Steel Products Division McIntosh Corporation, Chicago, Ill.

[22] Filed: Dec. 26, 1974

[21] Appl. No.: 536,651

[52] U.S. Cl. ..... 72/305; 72/306; 72/342; 72/373; 72/404

[51] Int. Cl.[2] ..... B21D 7/03

[58] Field of Search ..... 72/294, 305, 306, 342, 72/373, 381, 384, 404; 140/104

[56] References Cited

UNITED STATES PATENTS

| | | | |
|---|---|---|---|
| 1,215,332 | 2/1917 | Berg | 72/294 |
| 1,339,443 | 5/1920 | Evans | 72/404 |
| 1,713,964 | 5/1929 | Hoff et al. | 140/104 |
| 2,369,827 | 2/1945 | Holister | 140/104 |
| 3,010,492 | 11/1961 | Ryder et al. | 140/104 |
| 3,453,855 | 7/1969 | Morita | 72/342 |

*Primary Examiner*—C.W. Lanham
*Assistant Examiner*—Gene P. Crosby
*Attorney, Agent, or Firm*—Hill, Gross, Simpson, Van Santen, Steadman, Chiara & Simpson

[57] ABSTRACT

Automatic apparatus and method for simultaneously forming eyes at each end of a leaf spring blank in which hydraulic clamps clamp each end of a spring blank into a working position, hydraulic knock-downs knock down the ends of the spring blank about gooseneck forms advanced in alignment with and beneath the clamping surfaces of the clamps and partially form the ends of the blank, scarfing knives advance with scrolling dies to cut the extreme ends of the blank to conform to the underside of the gooseneck forms. The scrolling dies are advanced toward the ends of the spring blank to further form the ends of the spring blank to a semicircular form. Sizing pins are advanced through the semicircular form of the spring blank, and the scrolls are further advanced to conform the eyes with the anvil and form the spring to size about the sizing pins. The sizing pins are then removed and the formed blank may be passed to a quenching solution.

12 Claims, 9 Drawing Figures

AUTOMATIC APPARATUS AND METHOD FOR SIMULTANEOUSLY FORMING EYES ON EACH END OF A LEAF SPRING BLANK

BACKGROUND OF THE INVENTION

Heretofore, connecting eyes have been formed on leaf springs by separately forming the eyes at each end of the spring blank. This required the heating of one end of the blank and forming the eye by a series of forming and rolling dies and then heating the opposite end of the blank and forming the opposite end of the blank in a similar manner. The entire blank must then be heated to an annealing temperature and then quenched, requiring three die stations and sets of tooling with the transfer of the blank into each die station, as well as three separate heating operations.

In the spring forming operation of the present invention, the spring blank is heated to a working temperature and then clamped adjacent its opposite ends and the eyes are formed at each end of the blank in a series of forming operations, resulting in the forming of the eyes to size in a cycle of substantially five seconds, as the blank is passed through the machine.

This, except for the quenching and punching after the eyes are formed, is attained at one station by clamping the heated blank adjacent its opposite ends with the portions of the blank to form the eyes projecting beyond clamping anvils. Gooseneck-shaped forming dies are then moved beneath the projecting end portions of the blank and the ends are knocked down about the goosenecks by hydraulic knock-downs. Scarfing knives projecting from scrolls cut the extreme end portions of the blank to conform to the undersides of the goosenecks. The goosenecks are then withdrawn while the scrolls advance to partially form the blank ends. Sizing pins are then moved into the partially formed ends of the blank and the scrolls advance to conform the blank to the sizing pins and back finishing dies of the clamping anvils. The eye pins are then withdrawn as are the scrolls. The clamps then release the formed blank which then is passed from the machine and punched and quenched. All of the operations are performed by hydraulic cylinders and pistons controlled by solenoid valves and operated in such a sequence as to consecutively form the blank with no interruptions.

The advantage of the invention is that the eyes may be formed to size at each end of a spring blank in a series of cyclic forming operations at a single station.

Another advantage of the invention is that the forming operation, including the operation of clamping the blank in position, may be operated by hydraulic devices under the control of solenoid operated valves operated in preselected sequences.

A still further advantage of the invention is that eyes may be formed simultaneously at both ends of the blank or may be formed separately at one end or the other of the blank, where the blank is such a blank as requires only a single eye.

A still further advantage of the invention is that the forming operation requires only one heating operation, both for forming and quenching the blank.

Another advantage of the invention is that the apparatus is designed for automation and the blank can be passed completely through the machine and eyes may be formed to size at each end of the blank in cycles of substantially five seconds for each spring blank.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure.

DESCRIPTION OF PREFERRED EMBODIMENT OF INVENTION

Figure 1:
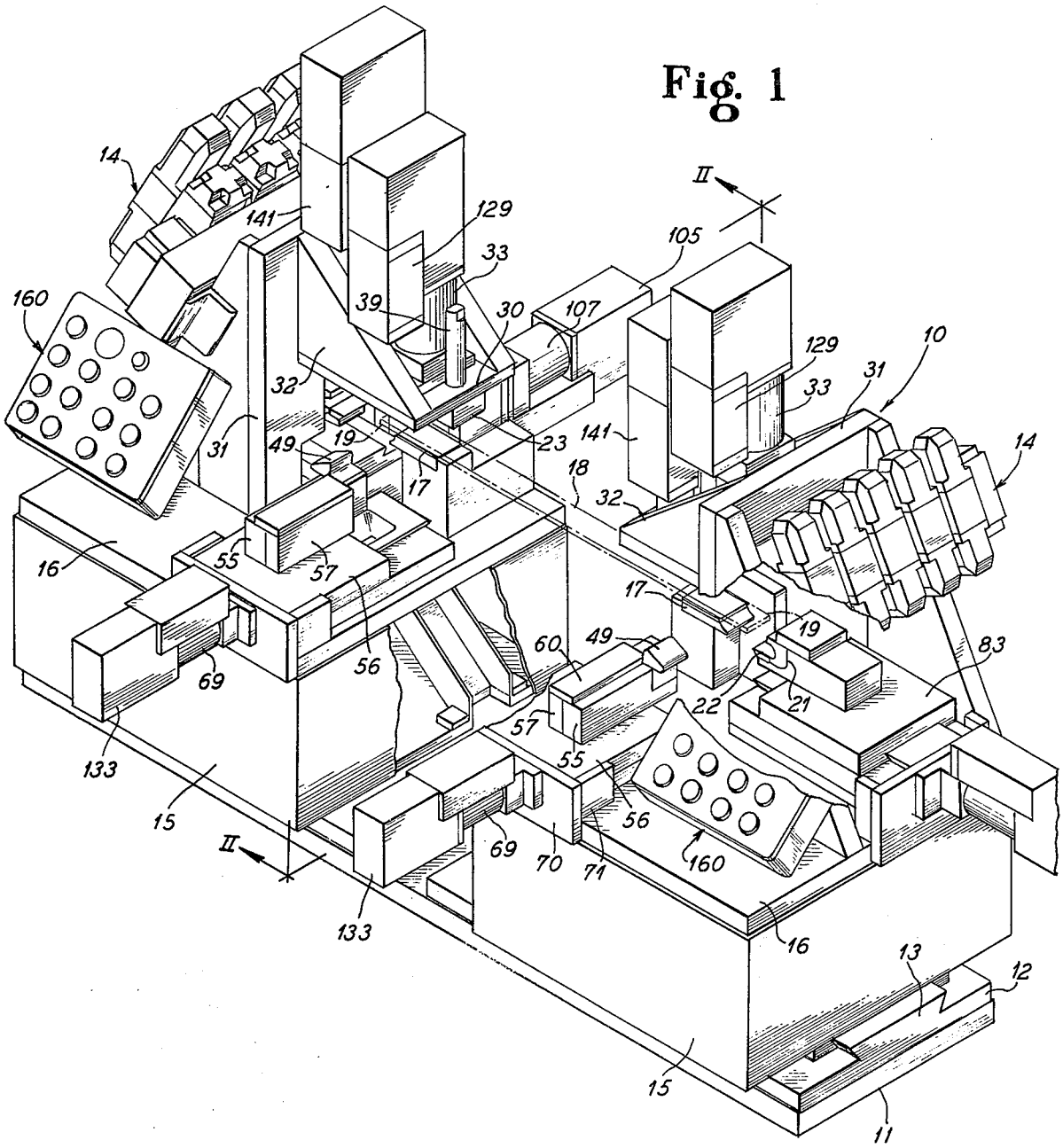
FIG. 1 is a fragmentary isometric view of a double eye forming machine constructed in accordance with the principles of the present invention with certain parts broken away.

In FIG. 1 of the drawings a double eye forming machine 10 constructed in accordance with the principles of the present invention is illustratively shown, with certain structural and support parts broken away in order to show certain details which would normally be obscured. The eye forming machine 10 includes a base 11 extending for the length of the machine. A guide plate 12 extends along said base plate and has a dovetail guide 13 extending therealong forming an adjustable mounting for housings 15 to accommodate adjustment of said housings 15 in accordance with the length of the spring blank on which eyes are to be formed.

The clamping and forming dies for each end of the spring blank are mounted on the housings 15 and are of a similar construction at each end of the machine, so one end of the machine only need herein be shown and described.

The housings 15 at each end of the machine may be adjustably moved toward and from each other by self-locking screw devices (not shown) or may merely be moved by hand and clamped in position. The adjusting mechanism forms no part of the present invention so need not herein be shown or described.

The dovetail guide 13 has guiding engagement with the bottom of the housing 15 in a conventional manner so not shown or described in detail. Each housing 15, besides forming a support for the forming dies, also forms a support for a bank of solenoid valves 14 and controls therefor, as well as cylinders and pistons operated and controlled thereby, to carry out the eye forming operations. Adjustment of the housing 15 along the guide plate 12 may position an anvil 17 in the proper position in accordance with the length of the leaf spring upon which eyes are to be formed, to support the ends of the leaf spring with the end portions thereof projecting beyond the anvils distances sufficient to provide spring material to form the eye. It is, of course, understood that the leaf spring may be supported on an anvil on each housing 15 and clamped thereto when an eye is formed at one end of the spring blank only, or when eyes are simultaneously formed at both ends of the spring blank.

The housing 15 is generally rectangular in form with bottom guides (not shown) mating with the dovetail guides 13 extending along the guide plate 12 and has a top base plate 16 forming a support for the dies and operating mechanisms therefor as will hereinafter more clearly appear as this specification proceeds.

The forming and clamping anvil 17 is mounted on the base plate 16 adjacent the inner end thereof to support the underside of an end of a leaf spring blank 18 with an overhanging end portion 19 projecting outwardly toward a scroll 21 and scarfing knife 22.

A clamping plate 23 is mounted on the bottom of a clamp holder 24. The clamping plate 23 has guide members 25 extending beyond the outer end thereof toward a knock-down 26. The guide members 25 are secured to the clamping plate 23 as by cap screws 27 and may be adjustable toward and from each other to conform to the width of spring blanks clamped to the anvil 17. The clamping plate 23 has an inclined bottom surface 29 conforming to the form of the spring blank 18 when placed on the anvils 17 to clamp the spring blank to the anvils in inwardly spaced relation with respect to the end portions which are to form the eye.

Figure 9:
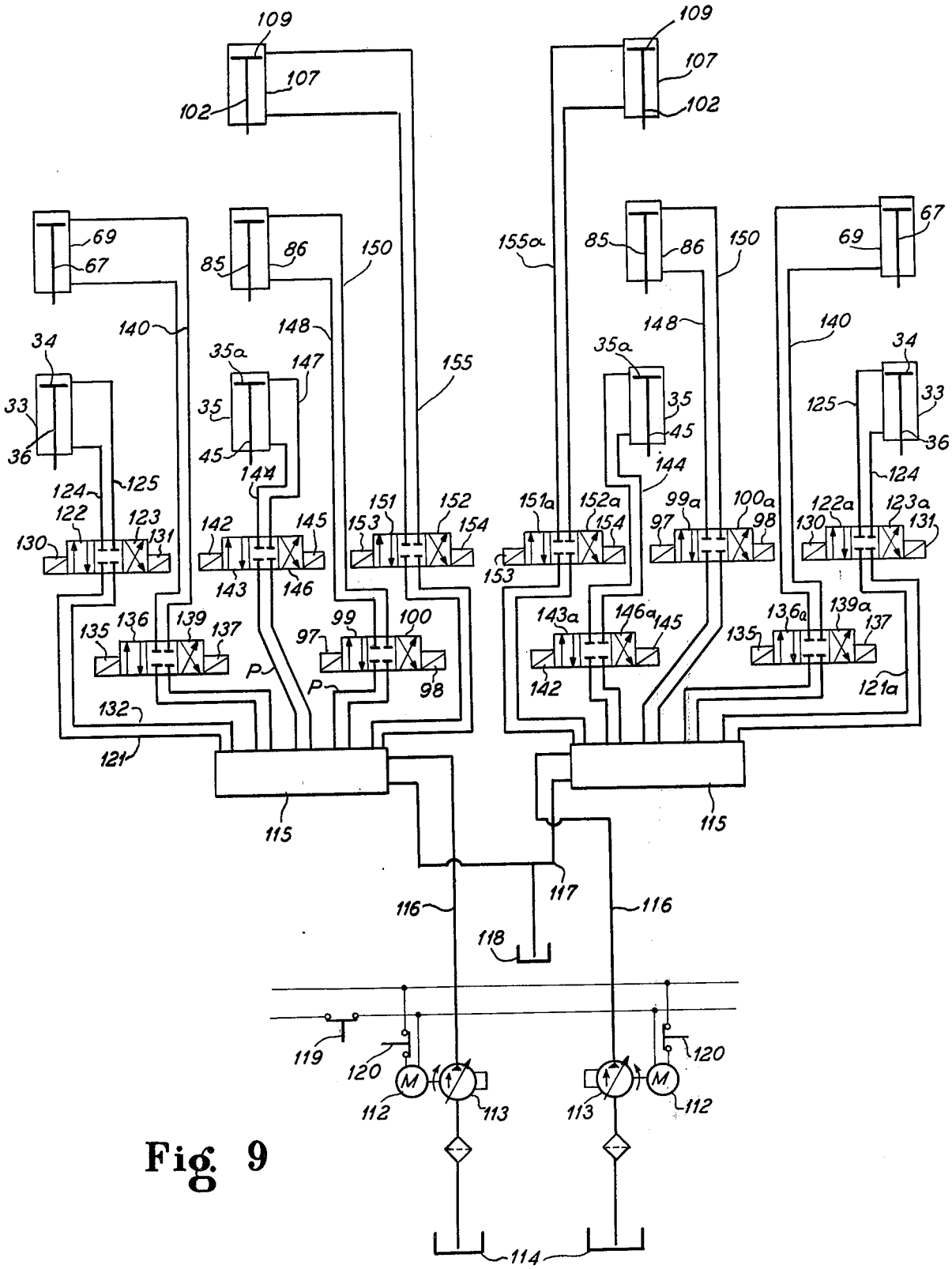
FIG. 9 is a diagrammatic view diagrammatically illustrating the hydraulic system for simultaneously forming eyes at each end of a single spring blank.

The clamp holder 24 abuts the bottom of a mounting plate 30 (FIG. 4) suitably mounted on a vertical mounting plate 31 and extending horizontally inwardly therefrom. Gusset plates 32 brace the mounting plate 30 to the vertical mounting plate 31 and give it sufficient rigidity to support a cylinder 33 having a piston 34 therein (FIG. 9). Said cylinder and piston are disposed adjacent the outer end of said mounting plate. A knock-down cylinder 35 having a piston 35*a* therein (FIG. 9) is spaced inwardly of the cylinder 33 and forms an actuating means for the knock-down 26. The cylinder 33 has a piston rod 36 depending therefrom through the mounting plate 30 and threaded in the clamp holder 24 and secured thereto as by a pin 37. The clamp holder 24 also has a guide pin 39 extending upwardly therefrom and slidably mounted in a bearing 40 in the cylinder mounting plate 30. The supply of fluid under pressure to one end of the cylinder 33 will thus move the clamp 23 into engagement with the leaf spring on the clamping and forming anvil 17 and hold the leaf spring thereto. In a contrary manner, the supply of fluid under pressure to the opposite end of the cylinder 33 will raise the clamp 23 to the position shown in FIG. 4.

The knock-down cylinder 35 is shown as having a flange 41 extending about its lower end portion abutting an apertured plate 42 on the top of a sleeve 43, secured to the cylinder mounting plate 30 as by cap screws 44.

Figure 4:
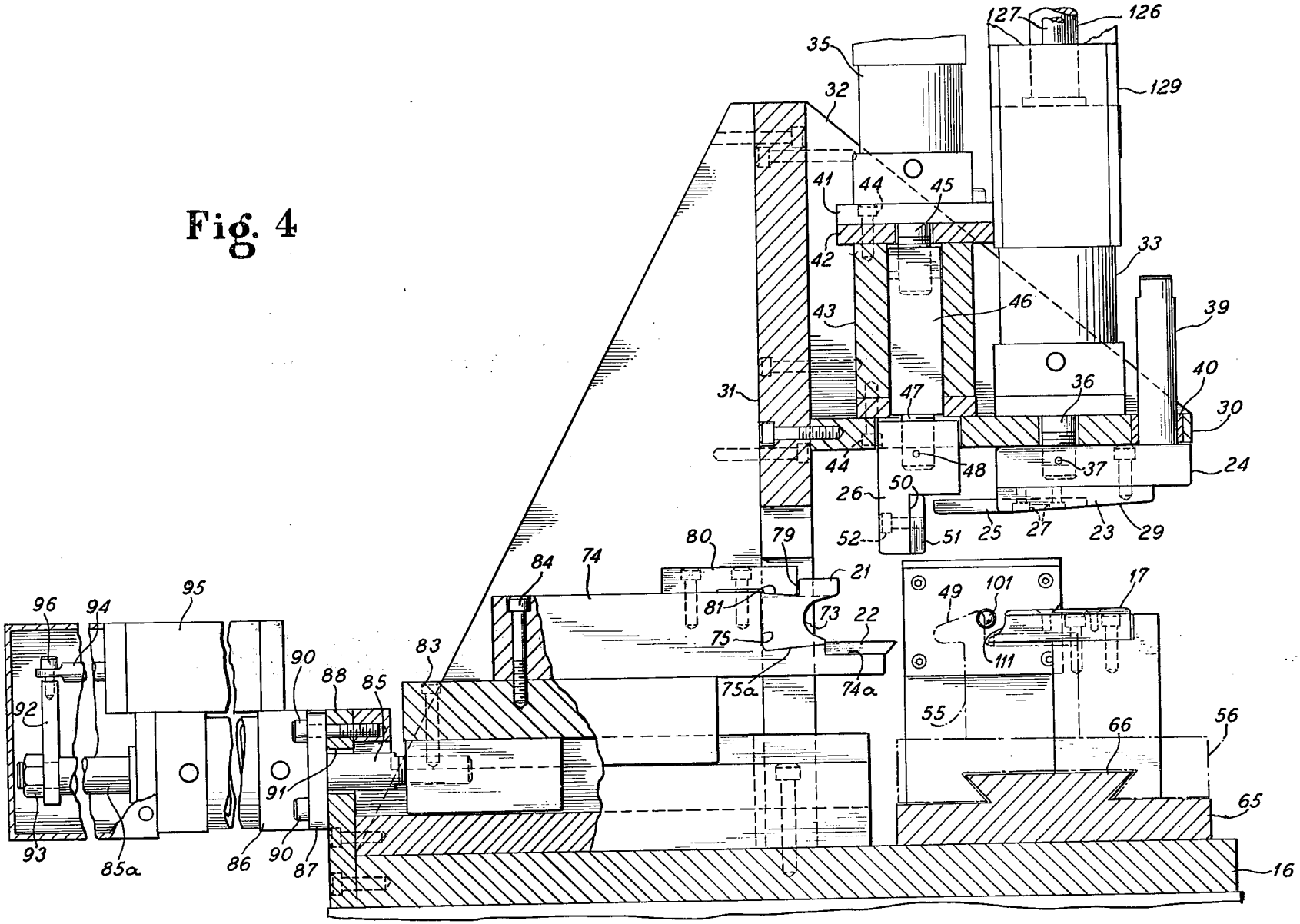
FIG. 4 is a sectional view taken substantially along lines IV—IV of FIG. 2.
Figure 5:
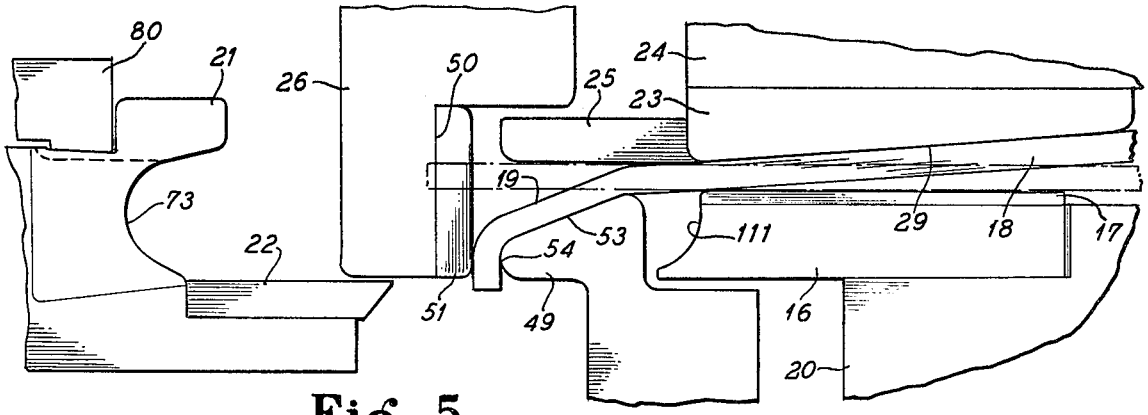
FIGS. 5, 6, 7 and 8 are diagrammatic views illustrating the operations of forming an eye at one end of a spring blank.

The cylinder 35 has a piston 35*a*therein (FIG. 9) having a piston rod 45 depending therefrom. Said piston rod 45 is shown as being threaded on the upper end of a pin 46 slidably guided along the inside of the sleeve 43. The pin 46 in effect forms an extension of the piston rod 45 and has a reduced threaded end portion 47 threaded in the knock-down 26 and secured thereto as by a pin 48. The knock-down 26 passes between the guides 25 and engages the portion 19 of the leaf spring projecting beyond the anvil 17 to knock said end of the spring down about a gooseneck 49 (FIGS. 4 and 5). The knock-down 26 has a recessed portion facing the leaf spring providing a vertical abutment surface 50 abutted by a wear plate 51 secured to said surface as by cap screws 52. The wear plate 51 has a rounded lower end portion engaging the end 19 of the leaf spring blank and bending said end to generally conform to an inclined top surface 53 of the gooseneck 49 and to curve about an arcuate end portion 54 of said gooseneck.

Figures 2, 3:
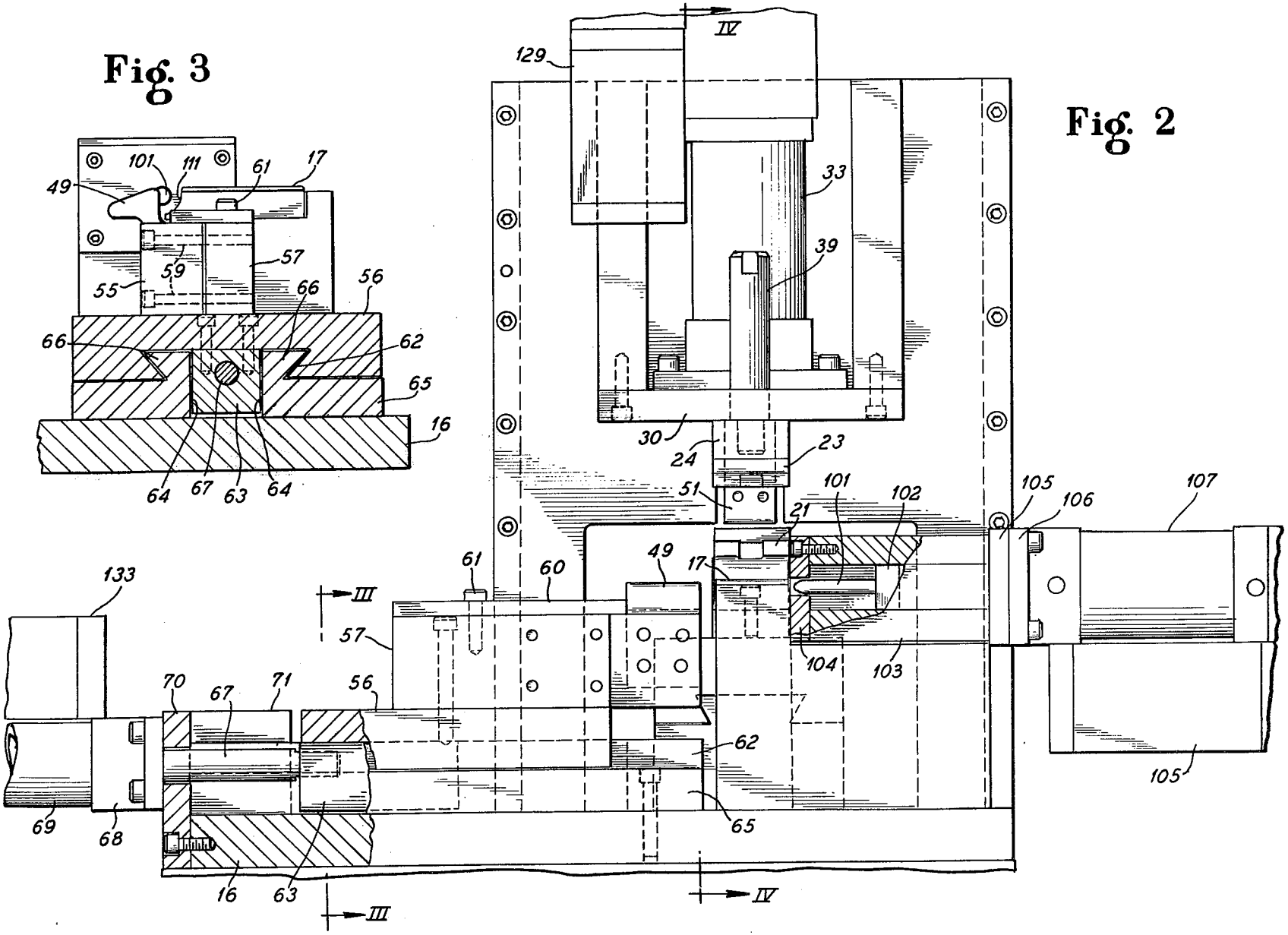
FIG. 2 is a transverse sectional view taken through the machine substantially along lines II—II of FIG. 1.
FIG. 3 is a fragmentary sectional view taken substantially along lines III—III of FIG. 2.

The gooseneck 49, as shown in FIGS. 2 and 3, is on the upper end of a block 55 supported on a guide plate 56 and abutting along its outer end a block 57, and is secured to said block 57 as by cap screws 59. A retainer plate 60 abuts the top portions of the blocks 55 and 57 outwardly of the gooseneck to retain said blocks in alignment with each other. Cap screws 61 are provided to secure the retainer plate 60 to the tops of the blocks 55 and 57.

The support and guide plate 56 has a dovetail guide 62 extending therealong and opening to the bottom thereof and has a block 63 depending from the center of said dovetail guide along a slot 64 formed in a dovetail guide plate 65, and having partial dovetail guides 66 extending from said slot and guided in the dovetail guide 62. The block 63 provides a mounting for a piston rod 67 extensible from a cylinder 69 mounted at its actuating end on a mounting member 70 abutting the outer end of a block 71. The mounting member 70 also abuts the end of the base plate 16 and is suitably secured thereto as by cap screws.

Figure 7:
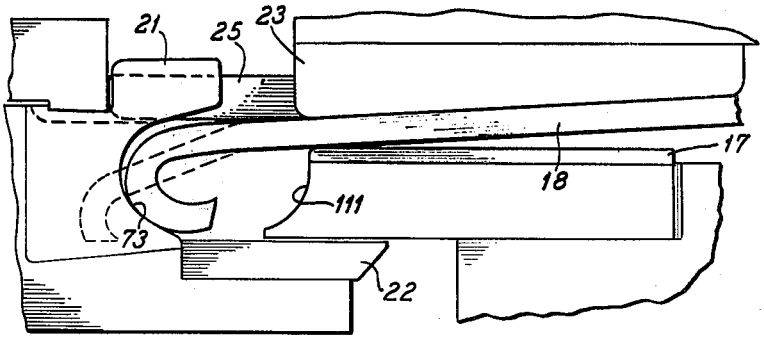

The piston rod 67 extensible from the cylinder 69 is suitably secured to the block 63 for moving the plate 56 along the dovetail guides 66 and positioning the gooseneck 49 into alignment with the end of the anvil 17 beneath the projecting portion 19 of the spring blank 18, as shown in FIG. 5, to position the gooseneck forming die between the guides 25 and cooperate with the wear plate 51 of the knock-down 26 to form the eye end of the leaf spring 18 along the inclined and arcuate end die surfaces 53 and 54 of the gooseneck, to thereby form the leaf spring to accommodate the end thereof to be scarfed by a scarfing knife 22 projecting from the lower end portion of the scroll 21. As the scarfing knife scarfs the end of the spring blank 18, the gooseneck 49 is retracted by its cylinder and piston to accommodate a die surface 73 of the scroll 21 to move in between the guides 25 and engage the knocked-down end of the spring blank and form the end portion of the spring blank into a hook-like form, as shown in FIG. 7.

Figure 6:
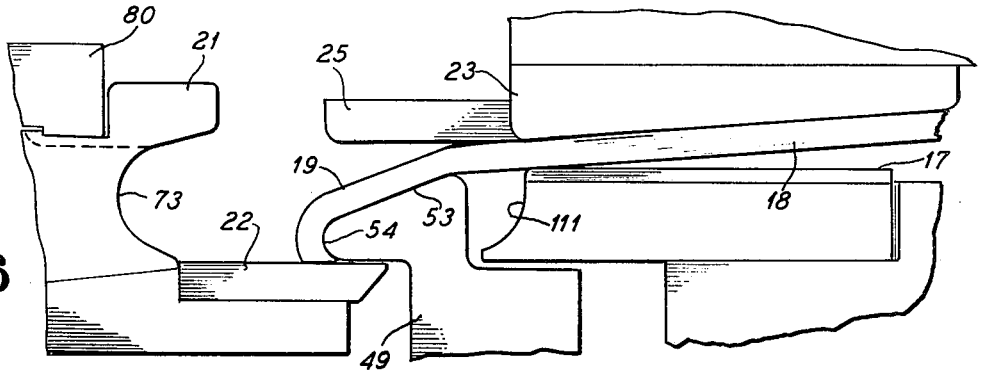

The scroll 21 is in the form of a recessed arcuate die having the recessed die surface 73 and has a keystone-like body portion mounted on the end of a block 74 in a recessed portion 75 thereof, having an inclined bottom wall 75*a* corresponding to the bottom wall of the keystone-like body portion. The scarfing knife 22, as shown in FIG. 4, is suitably mounted in an upwardly opening recessed portion 74*a* of the block 74 with its top surface flush with the bottom of the arcuate die surface 73 of said scroll, as shown in FIG. 4. The upper wall of the keystone-like body of the scroll body portion terminates into a vertical abutment surface 79 adapted to be engaged by a retainer key 80 secured to the top of the die block 74. The retainer key 80 has an inclined bottom surface 81 adjacent the inner end thereof conforming to the keystone-like body of the scroll 21 to positively lock said scroll to the die block 74 and move said scroll by movement of said body toward and from the anvil 17 to scarf the end of the spring shown in FIG. 6 and perform the scrolling operation shown in FIG. 7, and retract said scroll after the formation of the eye on the end of the spring.

A cylinder 86 has an inner flange 87 abutting and mounted on a plate 88 secured to a guide block 89 as by cap screws 90. The plate 88 also abuts the base plate 16 and is secured thereto and has an apertured portion 91 with a piston rod 85. As shown in FIG. 4, the piston rod 85 extends entirely through the cylinder and is connected to its piston (not shown) intermediate its ends. An outer extension portion 85*a* of said piston rod is shown as having an arm 92 mounted thereon and secured thereto as by a nut 93 threaded on a reduced portion of said rod portion 85*a*. The upper end of the arm is connected with a rod 94 for successively operating a series of limit switches (not shown) in a limit switch housing 95. The outer end of the rod 94 is shown as flattened and secured to the upper or free end of the arm 92 as by a cap screw 96. The rod 94 thus operates one of five limit switches (not shown) in the housing 95, dependent upon the direction of movement of said rod, to energize or de-energize solenoids 97 or 98 to effect the forming operation of the eye by the operation of solenoid controlled valves 99 or 100, which may be spring biased into a closed position.

Figure 8:
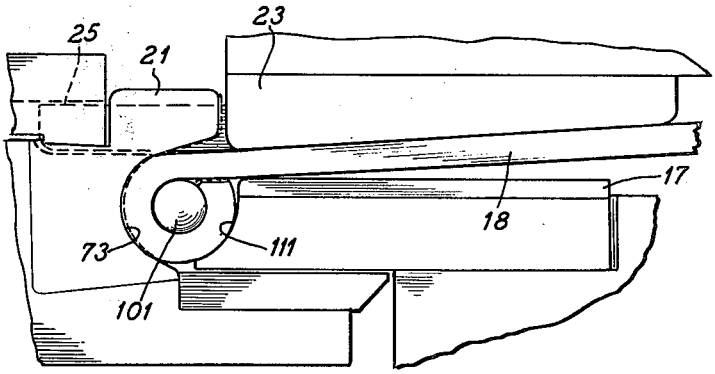

Cooperating with the forming die 73 and scroll 21 and movable laterally thereof is a sizing pin 101 (FIGS. 4 and 8). The sizing pin is on the end of an extension 102 of a piston rod 102*a* (FIG. 9). The extension 102 is rectilinearly guided in a rectangular guide 103 and abuts at its outer end an annular plate 104, forming a guide for the pin 101, when the piston rod is in an extended position and the sizing pin is in the position shown in FIG. 8. The guide 103 extends inwardly of the inner end of a cylinder 107 having a piston 109, diagrammatically shown in FIG. 9, and having the piston rod 102*a* extending therefrom (FIG. 9) for moving the sizing pin into the eye as formed by the scroll 21 and accommodating the sizing pin to size the eye to size in cooperation with the die surface 73 of the scroll and a back finishing die surface 111 of the anvil 17.

Referring now in particular to the hydraulic system schematically shown in FIG. 9, the system is duplicated for each forming head except the valves for one head operate in a reciprocal manner to those of the other head, so the same part numbers will be applied to similar parts for each head with the reciprocal valves and lines designated by the suffix *a*. The respective solenoids, however, for each head will be given the same part numbers. The system for one head, however, need only be described in detail herein.

As shown in FIG. 9, separate motors 112 are provided for each head and are connected to drive pumps 113 drawing hydraulic fluid from tanks 114, which may be a single tank, to supply fluid under pressure to separate manifolds 115 through pressure lines 116. A drain line 117 connects the two manifolds to return fluid to a tank 118, which could be the tanks 114 or could be connected therewith. The motors 112 are illustratively shown as started by the closing of a main starter switch 119 as separate starters 120 for each motor are closed. The separate starters 120 are provided to de-energize one head and energize the other head. When, however, only one head is forming eyes as for slipper-type springs, the other head clamp 23 will operate to effect clamping for both ends of the spring. This is actuated by operation of selector switch buttons on a control panel 160 for each head.

The electric circuit may be a simple alternating or direct current circuit and may also include the controls for the solenoids operating the hydraulic valves of the system in the required sequence, and is no part of the present invention so need not herein be shown or described. It is, of course, understood that various conventional circuits may be used and connected to sequentially operate the clamps and successive dies or to enable any clamp or die to be individually operated when required.

In referring to the hydraulic system, it should be understood that the valves are of the center closed type and may be spring biased into a closed position and that the valves on each side of center for each head are operated by individual solenoids controlled by limit switches.

The hydraulic system for the left-hand head, as shown in FIG. 9, includes a pressure line 121 leading from the manifold 115 to a pair of solenoid operated valves 122 and 123, operating the clamp 23. The valve 122 is positionable by a solenoid 130 to supply fluid under pressure to the piston rod end of the cylinder 33 through a pressure line 124 to retract the clamp. The valve 123 is operated by a solenoid 131 to supply fluid under pressure to a pressure line 125 and the head end of the cylinder 33 to move the clamp 23 into its clamping position and hold the clamp in this position. Upon retraction of the clamp, fluid is returned from the head end of the cylinder through the fluid pressure line 125 and the return line leading from the valve back to the manifold 115.

As shown in FIG. 4, a rod 126 slidably extends from the tail end of the cylinder 33 and may be a continuation of the piston rod 36. The rod 126 has connection with a rod 127 slidably carried in a limit switch housing 129, containing limit switches (not shown) operable to energize a solenoid 130 for moving the valve 122 into position to release the clamp. The limit switch housing also contains a limit switch (not shown) operable to energize or de-energize the solenoid 131, moving the valve 123 to supply fluid under pressure to the head end of the cylinder 33 to advance the clamp 29 into the position shown in FIG. 5. The valve 123 thus serves to clamp the spring blank 18 to the anvil 17 and to hold said blank in clamping engagement with said anvil during the eye forming operation. A return line 132 leads from the valves 122 and 123 to the manifold 115 to be returned to tank 118.

On the right-hand head a pressure line 121*a* supplies fluid under pressure to valves 122*a* and 123*a*. A valve 123*a* energized by a right-hand solenoid 131 serves to retract the clamp while a valve 122*a* energized by a right-hand solenoid 130 serves to move the clamp into its clamping position and clamp the spring blank to the respective anvil 17.

The cylinders 69 for the goosenecks have a limit switch housing 133 mounted on one side thereof and containing a set of limit switches (not shown). Said limit switches may be operated by an extension (not shown) of the piston rod 67 extending from the head end of the cylinder 69 and controlling the energization of a solenoid 135, to move a valve 136 to supply fluid under pressure to return the gooseneck to the position shown in FIG. 1. A second limit switch (not shown) controls the energization of a solenoid 137 energizable to move a valve 139 to supply fluid under pressure through a pressure line 140 to move the gooseneck into alignment with the anvil 17 and the extension 19 of the spring blank 18, it being understood that the solenoid limit switches alternately energize and de-energize the respective solenoids in accordance with the position of the piston rod 67.

On the right-hand head, energization of a solenoid 137 for a valve 139*a* moves the valve 139*a* to supply fluid under pressure to the piston rod end of the respective cylinder 69. Energization of a solenoid 135 moves the respective valve 136*a* to supply fluid under pressure to the head end of the respective cylinder 69.

The knock-down cylinder 35 has a limit switch housing 141 mounted on the top thereof and extending along one side thereof containing a series of limit switches (not shown) operated by an extension (not shown) of the piston rod 45, to energize a solenoid 142 and effect movement of a valve 143 to supply fluid under pressure to the piston rod end of the cylinder 35 through a pressure line 144 and raise the knock-down to the position shown in FIG. 4. A limit switch (not shown) is operated from the extension of the piston rod 45 to energize a solenoid 145 and move a valve 146 to supply fluid under pressure through a pressure line 147 to the piston rod end of the cylinder 35, and to move the knock-down into position to first form the projecting end 19 of the spring blank 18 to the inclined surface of the gooseneck 49 and to then continue the forming operating to move the wear plate downwardly along the end of the spring blank and position the blank to extend downwardly about the end of the gooseneck in the position shown in FIG. 5.

On the right-hand head, a right-hand solenoid 145 is energized by its limit switch to move the valve 146*a* in position to supply fluid under pressure to the piston rod end of the cylinder 45 while a solenoid 142 is energized to move a valve 143 to supply fluid under pressure to the head end of the cylinder 35, and clamp the blank 18 to the anvil 17.

The forming cylinder 86 is shown in FIG. 4 as having a limit switch housing 95 mounted on the outside thereof and extending therealong. Said limit switch housing carries a series of limit switches (not shown) to perform a series of forming operations, including a first scarfing operation of the end of the spring blank (FIG. 6) and then scroll or form the spring blank to a hook-like form and thirdly, form the eye in cooperation with the back finishing die 111 of the anvil 17 about the sizing pin 101. This requires a series of limit switches to energize and de-energize the solenoids 97 and 98 in the required sequence and sequentially open and close the valves 99 and 100 to supply fluid under pressure to the piston rod end of the cylinder 86 through the valve 99 and a line 148 or through a valve 100 and a pressure line 150.

On the right-hand head, right-hand solenoids 97 and 98 are energized in the same order as the solenoids 97 and 98 on the left-hand head to first move the valve 99*a* to supply fluid under pressure to the piston rod end of the cylinder 86 and then to move the valve 100*a* to supply fluid under pressure to the head end of the cylinder 86.

The sizing pin 101 is advanced between the scarfed end of the spring blank and the back finishing die 111 of the anvil 17 and returned to its retracted position under the control of valves 151 and 152 operated by solenoids 153 and 154, respectively. Said solenoids 153 and 154 are energized and de-energized by a pair of limit switches (not shown) contained in limit switch housing 105 extending along the cylinder 107. The limit switches are operated in the required sequence by an extension (not shown) of the piston rod 102 extending from the piston 109 through the head end of the cylinder 107. Thus, upon energization of the solenoid 154, the valve 152 will be moved to supply fluid under pressure to the head end of the cylinder 107 through a pressure line 155 and advance a sizing pin into the position shown in FIG. 8. The pin will be retracted under the control of the valve 151 upon energization of the solenoid 153 and closing of the limit switch controlling energization of said solenoid.

On the right-hand head, a valve 151*a* is moved by energization of a respective solenoid 153 to retract the sizing pin, while a valve 152*a* is moved by energization of a respective solenoid 154 to extend the sizing pin to size the internal diameter of the eye.

In the operation of the machine as diagrammatically shown in FIGS. 5 through 8, as the spring blank is placed on the anvils 17 with the eye forming ends thereof projecting beyond the ends of the anvils distances sufficient to provide stock to form the eyes at the ends of the spring, the valves 123 and 122*a* will be positioned to advance the clamps 23 to clamp the spring blanks in position on the anvils. The valves 122, 122*a*, 123 and 123*a* for the respective heads are biased to hold fluid under pressure in the head ends of the clamping cylinders 33 and thus clamp the blank in position on its anvils when their solenoids are de-energized. The valves 139 and 136*a* may then be moved into position to advance the goosenecks 49 in alignment with the anvils 17 and beneath and in alignment with the projecting end portions 19 of the spring blank and remain in this position until the projecting end portions of the spring blank are formed to conform to the top and end surface of said gooseneck.

As the goosenecks are advanced in position, the valves 146 and 143*a* are positioned to actuate the knock-downs to knock down the projecting ends 19 of the spring blank about said goosenecks. The respective valves 143 and 146*a* will then be returned by their respective solenoids into position to retract the knock-downs.

The solenoids 98 will then be energized to position the respective valves 100 and 100*a* to advance the scroll and scarfing knife to scarf the ends of the spring blank to conform to the under-surface of the projecting end portions 19 of the spring blank when the eyes are formed.

The solenoid 135 on the left-hand head will then be energized to position the valve 136 to retract the left-hand gooseneck and the solenoid 137 on the right-hand head will be simultaneously energized to position the valve 139*a* to supply fluid under pressure to retract the right-hand gooseneck.

The scrolls 21 will then advance under the control of the valves 100 and 100*a* and the respective solenoids 98 to cause the die surfaces 73 of said scrolls to form the ends of the spring blank into scrolls or hook-like forms.

The valves 152 and 151*a* will then be positioned by the respective solenoids 154 and 153 to supply fluid under pressure to advance the eye pins and hold the eye pins in the advanced position. The scroll dies 73 will then be advanced to form the eyes to size about the eye pins and back finishing dies 111 of the anvils 17 by operation of the valves 100 and 100*a* energized by the respective solenoids 98. The respective solenoids 153 will then be energized to position the valves 151 and 151*a* to retract the eye pins. The respective solenoids 97 will then be energized to position the respective valves 99 and 99*a* to retract the scroll dies. The respective solenoids 130 on the left-hand head and 131 on the right-hand head will also be energized to move the respective valves 122 and 123*a* to retract the clamps and enable the spring with eyes formed to size on each end thereof to be punched at its center and then quenched.

It should be understood that the various switches are on control panels 160 and include a selector switch button selecting operation of both heads together or for operating either the right-hand head or the left-hand head. It is further understood that the head circuits may be isolated so that if one head should be down, the other head may be operated.

The control panel also includes a series of push buttons to separately operate the clamp and forming dies where required and has circuits in cooperation with the limit switches to effect cyclic operation of the clamp, knock-down and dies to effect the automatic sequential operation of the clamps, knock-downs and dies to automatically form eyes at both ends of the spring blank in a matter of seconds with one heating operation of the blank, and no change in position of a blank from the position of the blank on the anvils for clamping and forming and the removal of the blank at the termination of the eye forming operations. The punching and quenching operations are, of course, separate operations and require removal of the blank from the dies, but may be on the opposite side of the machine from that on which the blank is supplied to enable the entire blank forming operation, including the supply, punching and quenching, to be automatic.

I claim as my invention:

1. A method of simultaneously forming eyes at each end of a leaf spring blank comprising:

uniformly heating the spring blank to a predetermined uniform working temperature for the length thereof, passing the heated blank transversely of its length into a working position, clamping the opposite end portions of the blank in the working position to individual longitudinally spaced anvils, simultaneously advancing forms beneath each end portion of the blank transversely of the blank into alignment with the underside of the blank, vertically knocking down the ends of the blank about forms, then in an additional forming operation forming the end portions of the blank about the forms inwardly toward each other longitudinally of the blank and at the same time scarfing the ends of the blank as formed to conform to the bottom surface of the blank upon completion of the eye forming operation, simultaneously withdrawing the forms, continuing the forming of the ends of the blank after the withdrawing and scarfing operation to the form of final eyes by movement of forming dies longitudinally towards the partially formed ends of the blank and moving the partially formed ends of the blank about a stationary forming surface all in a simultaneous operation at both ends of the blank and then unclamping the blank and passing the completed blank laterally of the anvils for quenching.

2. The eye forming method of claim 1 in which eye pins are passed into the formed and scarfed ends of the blank, and the continuation of the forming of the ends of the blank is about the eye pins to form the scarfed ends of the blank to size, and then simultaneously withdrawing the eye pins prior to unclamping the blank.

3. The method of simultaneously forming eyes at each end of a spring blank of claim 2, wherein the forming operation is uninterrupted and the blank is passed transversely of its length for clamping from one side of the anvils and is passed transversely of its length for quenching from the opposite side of the anvils.

4. An apparatus for simultaneously forming eyes on opposite ends of leaf spring blanks, including:

a base, longitudinally spaced support frames mounted on said base for adjustable movement toward and from each other in accordance with the length of the spring blank, longitudinally spaced anvils mounted on said support frames for supporting engagement with opposite ends of a heated spring blank, and having unimpeded sides to receive a single leaf spring blank from one side thereof and accommodate discharge of a formed single leaf spring blank from the opposite side thereof, individual clamps in association with each anvil for clamping the opposite end portions of the spring blank to the anvils with the ends of the blank projecting longitudinally beyond the anvils, gooseneck formers in association with each anvil, means moving the gooseneck formers laterally into and out of alignment with the ends of the anvils, beneath the ends of the leaf spring projecting beyond each anvil, other means knocking down the ends of the blank about the gooseneck formers in a simultaneous operation, a separate scroll longitudinally spaced from each end of the blank in longitudinal alignment therewith and spaced longitudinally therefrom and each having a generally arcuate forming die surface in alignment with the knocked down ends of the blank, means moving the scrolls longitudinally toward each other to engage the knocked down ends of the blank upon lateral removal of the gooseneck formers from the blank and forming the ends of the blank into generally arcuate forms, said anvils each having a concave arcuate back finishing forming surface facing the cooperating scrolls, and said scrolls continuing longitudinal inward movement of the ends of the blank and forming the ends of the blank to the form of the arcuate back finishing die surfaces of the anvils to complete the eyes to form in a simultaneous operation at each end of the leaf spring blank.

5. The apparatus of claim 4 in which the scrolls each have a scarfing knife projecting therefrom towards the gooseneck formers for scarfing the ends of the blank as formed about the gooseneck formers prior to the operation of scrolling the ends of the blank.

6. The apparatus of claim 5 in which sizing pins are provided to size the eye to form and the clamps, knock-downs, goosenecks, scrolls, scarfing knives and sizing pins are operated by individual hydraulic cylinders and pistons under the control of solenoid operated valves.

7. The apparatus of claim 4 including sizing pins mounted on each support frame, means moving the sizing pins laterally to advance into the partially formed eyes prior to movement of the scrolls to apply pressure to conform the eye to the arcuate back finishing die.

8. The apparatus of claim 7 in which the support frames are mounted on the base for adjustable movement toward and from each other in accordance with the length of the spring blank and each support frame forms a support for a clamp, a knock-down, an anvil, a gooseneck, a scroll and a sizing pin and the apparatus for moving said clamp, knock-down, gooseneck, scroll and sizing pin into and out of their operative positions.

9. The eye forming apparatus of claim 8 wherein guide means arranged at right angles with respect to each other are provided for said clamps, goosenecks, knock-downs and sizing pins for guiding said clamps, goosenecks, knock-downs and sizing pins in rectilinear paths transversely of the leaf spring blank in horizontal and vertical directions toward and from their operative positions, wherein other guide means extending longitudinally of the spring blank are provided for said scrolls for guiding said scrolls toward and from their operative positions, and wherein said guide means for said scrolls and gooseneck are dovetail guide means and cooperate with said other guide means to retain said clamps, gooseneck, knock-downs, scrolls and sizing pins from torsional movement relative to each other with said scrolls guided for longitudinal aligned movement toward and from the opposite ends of the spring blank.

10. The eye forming apparatus of claim 8 where an individual fluid pressure cylinder and piston means are provided for moving said clamps, knock-downs, goosenecks, scarfing knives, scrolls and sizing pins into and out of their operative positions in a preselected sequence, wherein individual fluid pressure valve means are provided for the head and piston rod ends of said fluid pressure cylinders, wherein said valve means are center biased into closed positions and wherein individual solenoids for each of said valve means are energizable to effect the clamping and release of said clamps and the forming or withdrawing operation of an associated die and means are provided for energizing said solenoids in accordance with positions of the associated cylinders and pistons and are connected with said valve means to effect operation of said heads in a preselected simultaneous sequence at each end of the leaf spring blank.

11. The eye forming head of claim 10 wherein selector means are provided to effect the operation of the clamps, gooseneck formers, means knocking down the ends of the blank about the gooseneck formers, the scrolls and sizing pins to effect a forming operation at one end or the other of the leaf spring or simultaneous forming operations at both ends of the leaf spring.

12. The eye forming apparatus of claim 11 wherein means are provided for operating the clamps adjacent each end of the leaf spring when only one end of the leaf spring is formed into the form of an eye.

* * * * *